US010220357B1

(12) United States Patent
Hsueh

(10) Patent No.: US 10,220,357 B1
(45) Date of Patent: Mar. 5, 2019

(54) DECANTER FOR BOTTLED WINE

(71) Applicant: HUANG LIANG PRECISION ENTERPRISE CO., LTD., Kaohsiung (TW)

(72) Inventor: Chung-Kuei Hsueh, Kaohsiung (TW)

(73) Assignee: Huang Liang Precision Enterprise Co., Ltd., Kaohsiung (TW)

( * ) Notice: Subject to any disclaimer, the term of this patent is extended or adjusted under 35 U.S.C. 154(b) by 0 days.

(21) Appl. No.: 16/018,293

(22) Filed: Jun. 26, 2018

(51) Int. Cl.
*B01F 3/04* (2006.01)
*A47G 23/02* (2006.01)
*B67D 3/00* (2006.01)

(52) U.S. Cl.
CPC ..... *B01F 3/04744* (2013.01); *A47G 23/0241* (2013.01); *A47G 2400/045* (2013.01); *B01F 3/0446* (2013.01); *B01F 2215/0072* (2013.01); *B67D 3/0051* (2013.01)

(58) Field of Classification Search
CPC ..... B01F 3/04744; B01F 3/0446; B01F 2215/0072; A47G 23/0241; A47G 2400/045; B67D 3/0051
See application file for complete search history.

(56) References Cited

U.S. PATENT DOCUMENTS 4,676,401 A * 6/1987 Fox ..... B67D 1/0047 222/1
6,508,163 B1 * 1/2003 Weatherill ..... A47G 23/00 261/112.1
6,568,660 B1 * 5/2003 Flanbaum ..... B65D 47/06 222/189.07
D631,291 S * 1/2011 Kushner ..... D7/213
8,205,541 B2 * 6/2012 Barberio ..... B01F 3/0446 222/566
D705,598 S * 5/2014 Prokop ..... D7/392
8,783,665 B2 * 7/2014 Kuru ..... B01F 15/00928 222/566
8,870,167 B2 * 10/2014 Hardison ..... B01F 3/0446 222/567
D720,959 S * 1/2015 Mok ..... D7/392
D734,639 S * 7/2015 Lei ..... D7/213
9,719,061 B2 * 8/2017 Buzzard ..... C12G 1/00
2004/0124136 A1 * 7/2004 Bak ..... C12H 1/16 210/512.1
2010/0058933 A1 * 3/2010 Cheng ..... B01F 3/04595 99/323.1

(Continued)

*Primary Examiner* — Nicholas J. Weiss
(74) *Attorney, Agent, or Firm* — Rosenberg, Klein & Lee

(57) ABSTRACT

A decanter for bottled wine includes a main body having a first end, a second end, a bottle mouth insertion portion, an accommodating chamber and a wine guide portion, an outer cylinder covering the main body and a rotary shaft. At least one retaining ring is provided on an outer wall of the bottle mouth insertion portion. A bottom of the accommodating chamber has a plurality of equally spaced first through, protruding posts each having a second through hole, and an inner shaft seat. An inner end of the rotary shaft is pivotally connected to the inner shaft seat. The wine guide portion is disposed inside the second end of the main body and located at an outer end of the accommodating chamber. The wine guide portion includes an outer shaft seat for pivotally connecting an outer end of the rotary shaft and a plurality of wine guide holes.

3 Claims, 7 Drawing Sheets

(56) References Cited

U.S. PATENT DOCUMENTS

| | | | | |
|---|---|---|---|---|
| 2011/0024925 | A1* | 2/2011 | Mauffette | A47G 23/00 261/76 |
| 2013/0319253 | A1* | 12/2013 | Smith | B01F 3/04737 99/323.1 |
| 2014/0091107 | A1* | 4/2014 | Becker | B65D 25/40 222/190 |
| 2014/0263461 | A1* | 9/2014 | Prokop | B01F 7/00133 222/190 |
| 2015/0021794 | A1* | 1/2015 | Zhou | A47G 23/00 261/8 |

* cited by examiner

DECANTER FOR BOTTLED WINE

FIELD OF THE INVENTION

The present invention relates to a decanter that can decant bottled wine quickly. When the bottled wine flows outwardly to rotate a blade, the wine is oxygenated and aerated due to the rotation of the blade, the contact area between the wine and the air increases to greatly shorten the time to soften the wine, thereby decanting the wine quickly.

BACKGROUND OF THE INVENTION

Drinking a glass or two of wine every day may be pleasing. Some wines can reduce the chance of suffering from specific diseases. For example, grape wine (red wine or white wine, etc.) can prevent arteriosclerosis and heart disease. However, many bottled wines on the market may not be mature enough for drinking, especially for expensive young wines. In order to allow wines to be mature enough for drinking, decanting win is a common manner. During the decanting process, the grape wine is fully in contact with the air to soften the bitter tannins of the grape wine so as to eliminate miscellaneous flavors and to give the fragrance of the grape wine. The decanting process is mainly to allow the phenolic substances in the wine to polymerize into a precipitated state produced by larger molecules, allowing the wine to be oxygenated.

The most common way to decant wine is to pour bottled wine into a glass decanter. Different glass decanters give the wine a different degree of oxygenation. Although oxygen can make the wine better, it is also the biggest killer of wine. Excessive oxygenation may cause deterioration of the wine. The traditional glass decanter can only provide one-time decanting. If the time to decant the wine is too long, the flavor of the wine will be affected, and it can't effectively show the original wine quality of the wine.

Accordingly, a decanter 3 used for bottled wine is developed, which can improve the problem that the traditional decanter can only provide one-time decanting and the deterioration of the wine due to a long time of decanting the wine. As shown in FIG. 1 and FIG. 2, a conventional decanter 3 comprises a main body 3. The main body 3 has an upper end 311 and a lower end 312. The lower end 312 has a bottle mouth insertion portion 313 that is enlarged inwardly. At least one retaining ring 314 is provided on an outer wall of the bottle mouth insertion portion 313. The middle section of the main body 31 includes an accommodating chamber 315 with an opening facing upwardly. The bottom of the accommodating chamber 315 is provided with a plurality of equally spaced first through holes 316 passing through the bottle mouth insertion portion 313. The accommodating chamber 315 is provided with a plurality of first protruding posts 318 each having a second through hole 317. Each of the first protruding posts 318 is arranged between every two of the first through holes 316. The center of the accommodating chamber 315 is provided with a second protruding post 310 having a third through hole 319. The second protruding post 310 is higher than the first protruding posts 318.

When the conventional decanter 3 is applied to the bottle mouth of a wine bottle for guiding the bolted wine out, the wine is distributed into seven portions through the first through holes 316, the second through holes 317 and the third through hole 319. The height difference between the first through holes 316, the second through holes 317 and the third through hole 319 enables the wine to come in contact with the air to soften the wine for decanting the wine.

When in use, the above-mentioned conventional decanter for bottled wine still has some disadvantages. The time for the bottled wine passing through the first through holes 316, the second through holes 317 and the third through hole 319 to get in contact with the air is short, so the wine is not oxygenated or aerated enough. The effect of decanting the wine is poor.

Accordingly, the inventor of the present invention has devoted himself based on his many years of practical experiences to solve these problems.

SUMMARY OF THE INVENTION

The primary object of the present invention is to provide a decanter that can decant wine quickly. Through the height difference between first through holes and second through holes of a main body of the decanter, the air pressure of a wine bottle is different for bottled wine to flow outwardly. When the flowing wine passes through the plurality of first through holes and the plurality of second through holes toward a blade, the blade and a rotary shaft are rotated. When the wine is disturbed by the air due to the rotation of the blade, the contact area between the wine and the air increases to greatly shorten the time to soften wine. The purpose of the present invention is to obtain a perfect aeration or oxygenation of the wine in a very short time.

In order to achieve the above object, the present invention provides a decanter for bottled wine. The decanter comprises a main body, an outer cylinder, an inner shaft seat, a rotary shaft, and a wine guide portion. The main body has a first end and a second end. The first end of the main body has a bottle mouth insertion portion that is enlarged inwardly. At least one retaining ring is provided on an outer wall of the bottle mouth insertion portion. The main body includes an accommodating chamber at a middle portion thereof. A bottom of the accommodating chamber is provided with a plurality of first through holes passing through the bottle mouth insertion portion. The accommodating chamber is provided with a plurality of protruding posts each having a second through hole. Each of the protruding posts is arranged between every two of the first through holes. The outer cylinder covers the main body. The inner shaft seat protrudes from a center of the bottom of the accommodating chamber. An inner end of the rotary shaft is pivotally connected to the inner shaft seat. At least one blade is provided on an upper section of the rotary shaft. The rotary shaft and the blade are rotated in the accommodating chamber by the wine flowing outwardly. The wine guide portion is disposed inside the second end of the main body and located at an outer end of the accommodating chamber. A center of the wine guide portion is provided with an outer shaft seat corresponding to the inner shaft seat. An outer end of the rotary shaft is pivotally connected to the outer shaft seat. The wine guide portion has at least one wine guide hole around the outer shaft seat.

Preferably, the blade is spirally shaped.

Preferably, an outer end of the wine guide portion has a tapered trough that is reduced inwardly.

The decanter for bottled wine according to the present invention may be applied to the bottle mouth of a wine bottle. The height difference between the first through holes and the second through holes causes the air pressure of the wine bottle to be different for the bottled wine to flow outwardly. When the flowing wine passes through the plurality of first through holes and the plurality of second through holes toward the blade, the blade and the rotary shaft are rotated. When the wine is disturbed by the air due to the rotation of the blade, the contact area between the wine and the air increases to greatly shorten the time to soften the wine. The purpose of the present invention is to obtain a perfect aeration or oxygenation of the wine in a very short time.

DETAILED DESCRIPTION OF THE PREFERRED EMBODIMENTS

With regard to the technical means by which the present invention achieves the above-mentioned objects, embodiments of the present invention will now be described, by way of example only, with reference to the accompanying drawings.

Figure 1:
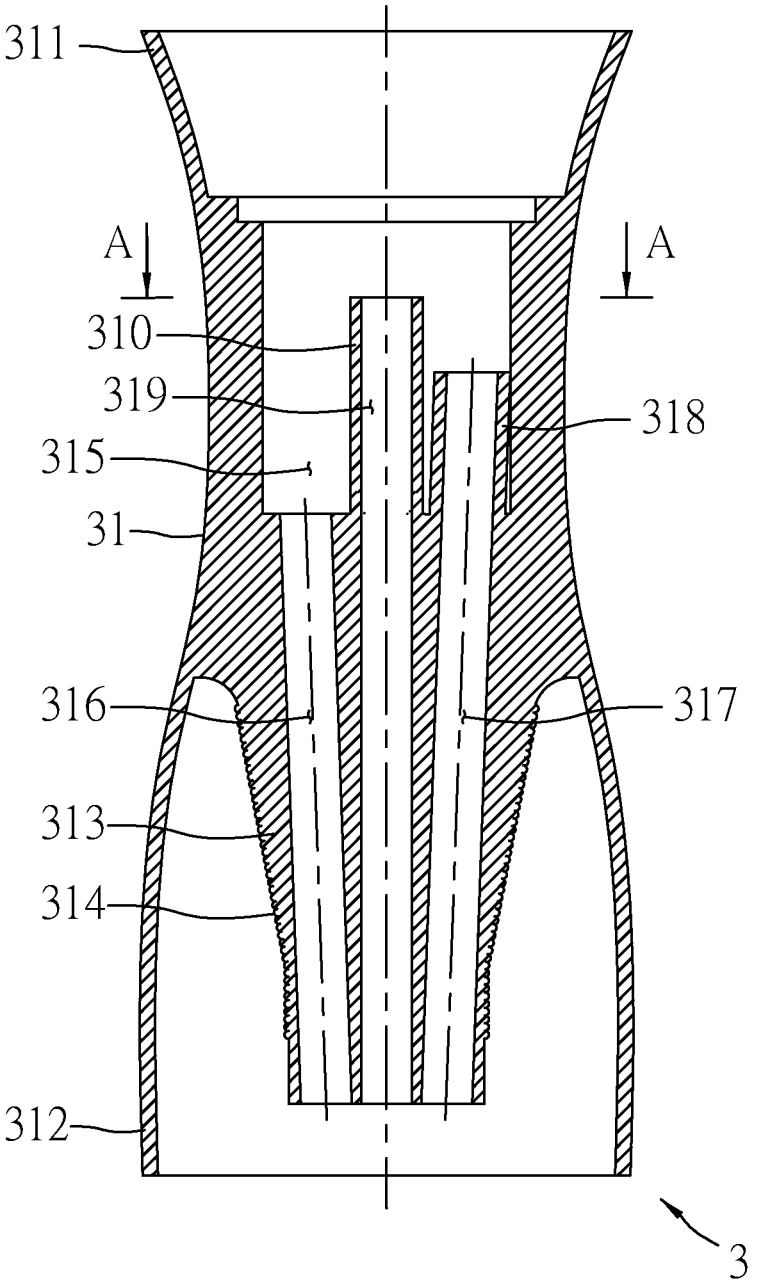
FIG.1(PRIOR ART)
FIG. 1 is a sectional view of a conventional decanter.
Figure 2:
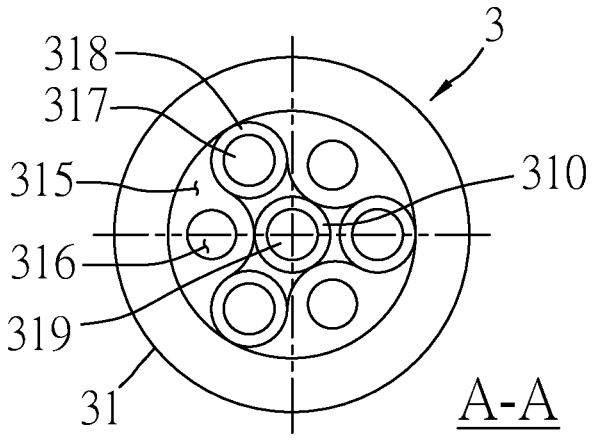
FIG.2(PRIOR ART)
FIG. 2 is a sectional view taken along line A-A of FIG. 1.
Figure 3:
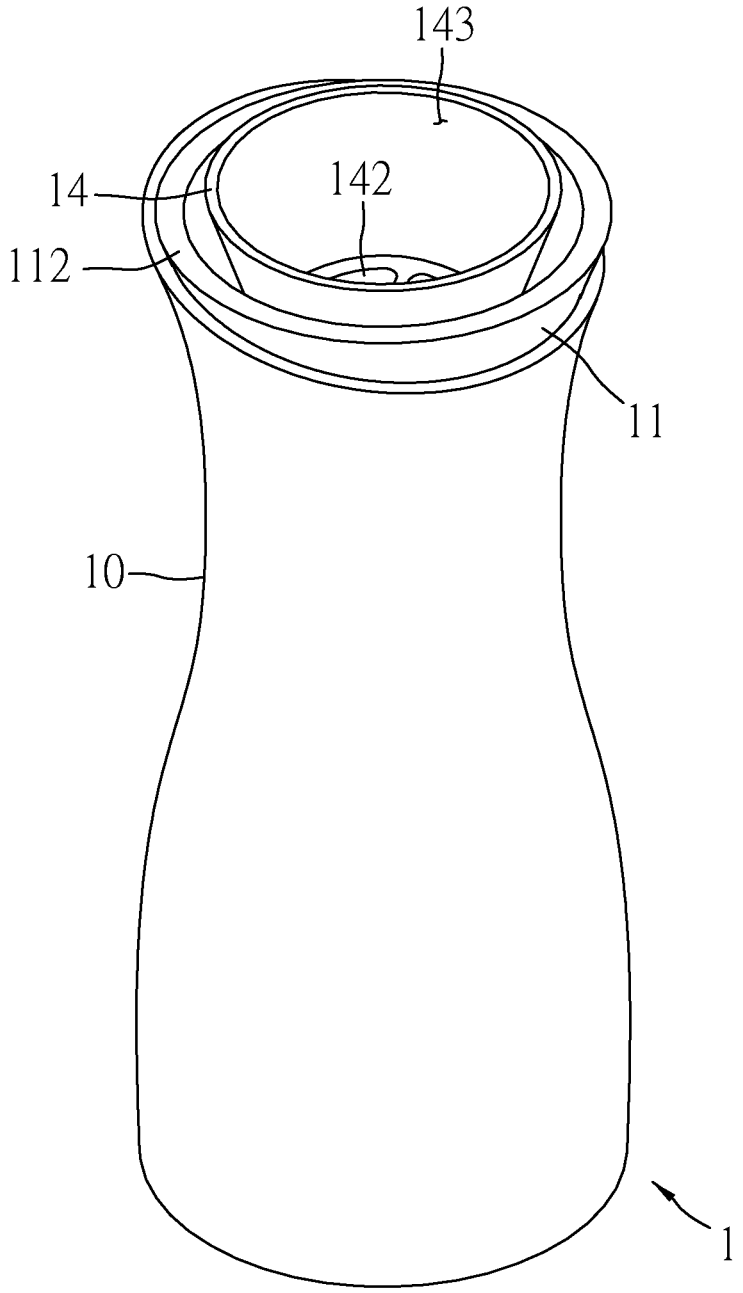
FIG. 3 is a perspective view of the decanter of the present invention.
Figure 4:
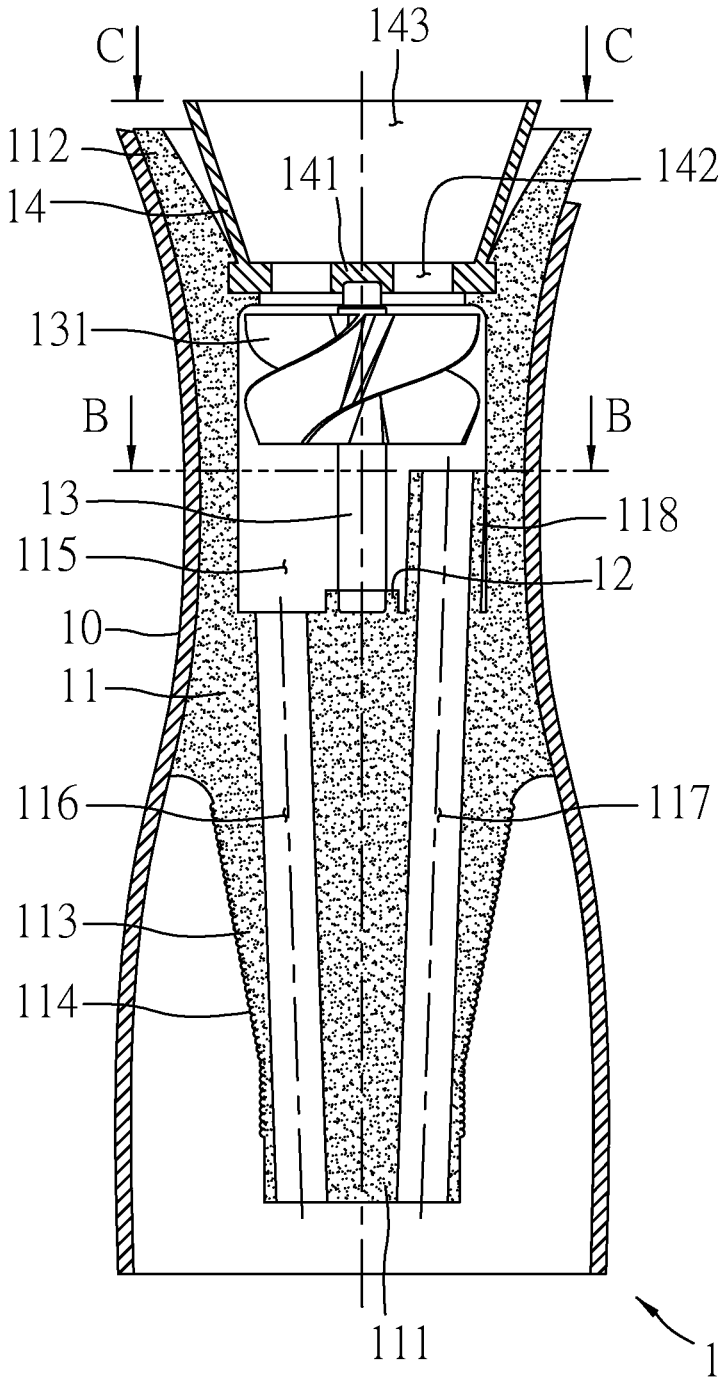
FIG. 4 is a sectional view of the decanter of the present invention.

Referring to FIG. 3 and FIG. 4, the present invention provides a decanter 1 for bottled wine. The decanter 1 comprises a main body 11, an outer cylinder 10, an inner shaft seat 12, a rotary shaft 13, and a wine guide portion 14. The main body 11 has a first end 111 and a second end 112. The first end 111 has a bottle mouth insertion portion 113 that is enlarged inwardly. At least one retaining ring 114 is provided on an outer wall of the bottle mouth insertion portion 113. The main body 11 includes an accommodating chamber 115 at a middle portion thereof. The bottom of the accommodating chamber 115 is provided with a plurality of first through holes 116 passing through the bottle mouth insertion portion 113. The accommodating chamber 115 is provided with a plurality of protruding posts 118 each having a second through hole 117. Each of the protruding posts 118 is arranged between every two of the first through holes 116. The main body 11 is integrally formed of an elastic rubber and has a curved recess portion.

The outer cylinder 10 covers the main body 11. The outer cylinder 10 also has a curved recess portion corresponding to the main body 11. Through the curved recess portion, the outer cylinder 10 and the main body 11 are positioned and won't be disengaged from each other.

Figure 5:
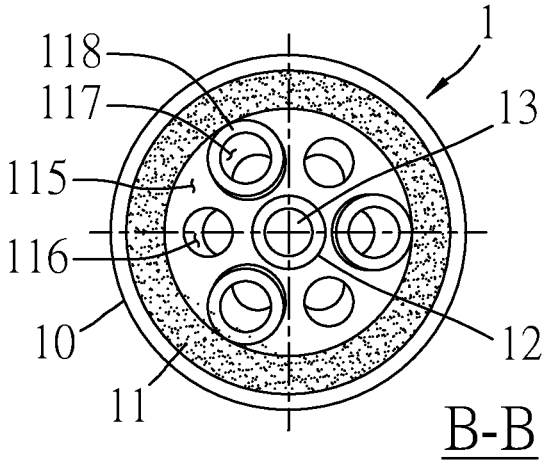
FIG. 5 is a sectional view taken along line B-B of FIG. 4.

Referring to FIG. 4 and FIG. 5, the inner shaft seat 12 protrudes from the center of the bottom of the accommodating chamber 115.

Figure 7:
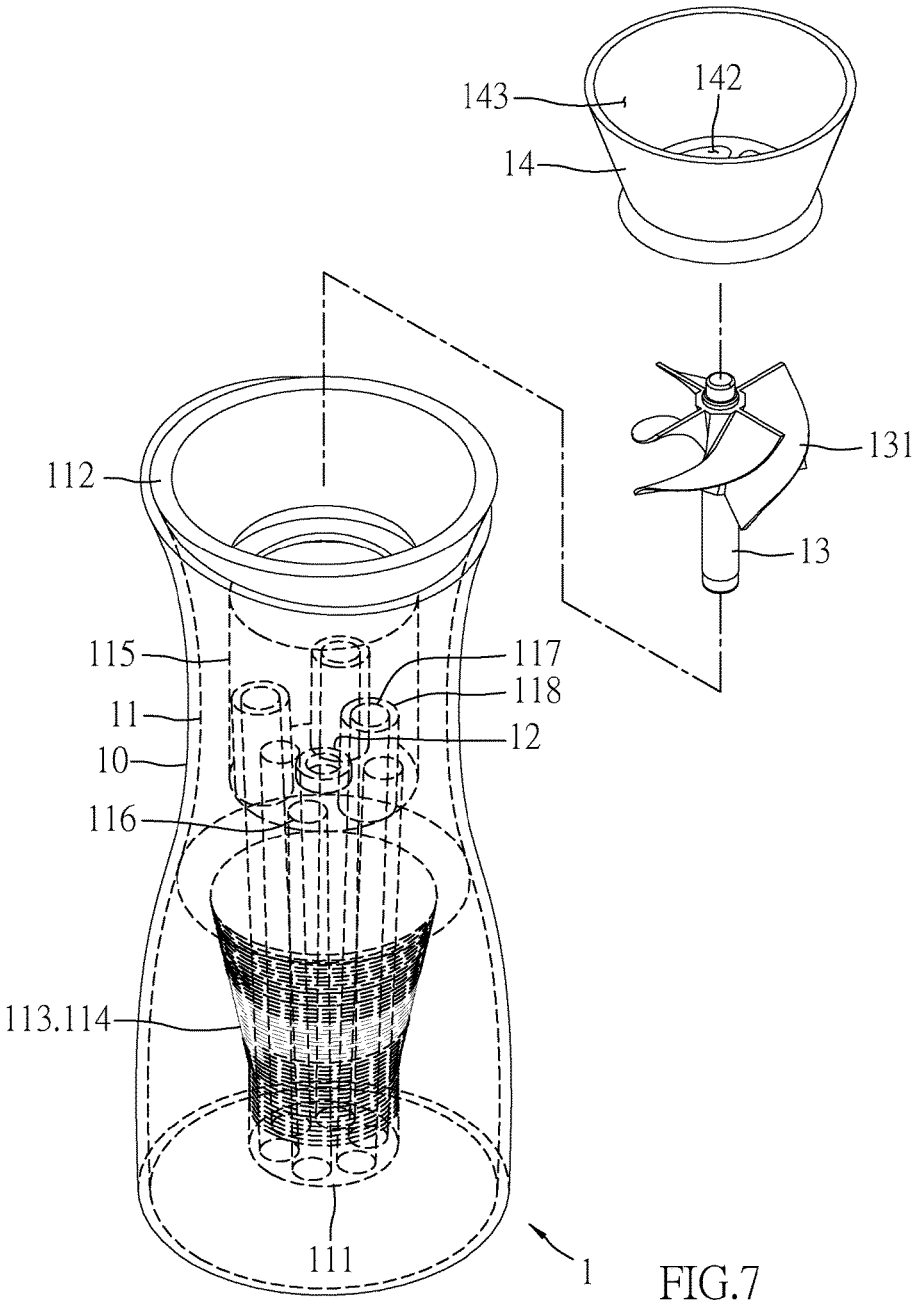
FIG. 7 is an exploded view of the decanter of the present invention.

Referring to FIG. 7, an inner end of the rotary shaft 13 is pivotally connected to the inner shaft seat 12. At least one blade 131 is provided on an upper section of the rotary shaft 13. The rotary shaft 13 and the blade 131 are rotated in the accommodating chamber 115 by the wine flowing outwardly. The blade 131 is spirally shaped.

Figure 6:
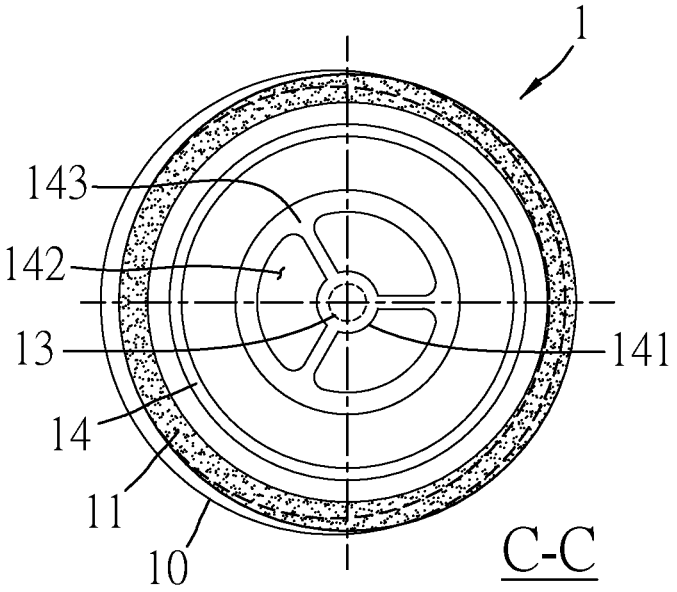
FIG. 6 is a sectional view taken along line C-C of FIG. 4.

Referring to FIG. 4 and FIG. 6, the wine guide portion 14 is disposed inside the second end 112 of the main body 11 and located at an outer end of the accommodating chamber 115. The center of the wine guide portion 14 is provided with an outer shaft seat 141 corresponding to the inner shaft seat 12. An outer end of the rotary shaft 13 is pivotally connected to the outer shaft seat 141. The wine guide portion 14 has at least one wine guide hole 142 around the outer shaft seat 141. An outer end of the wine guide portion 14 has a tapered trough 143 that is reduced inwardly.

Figure 8:
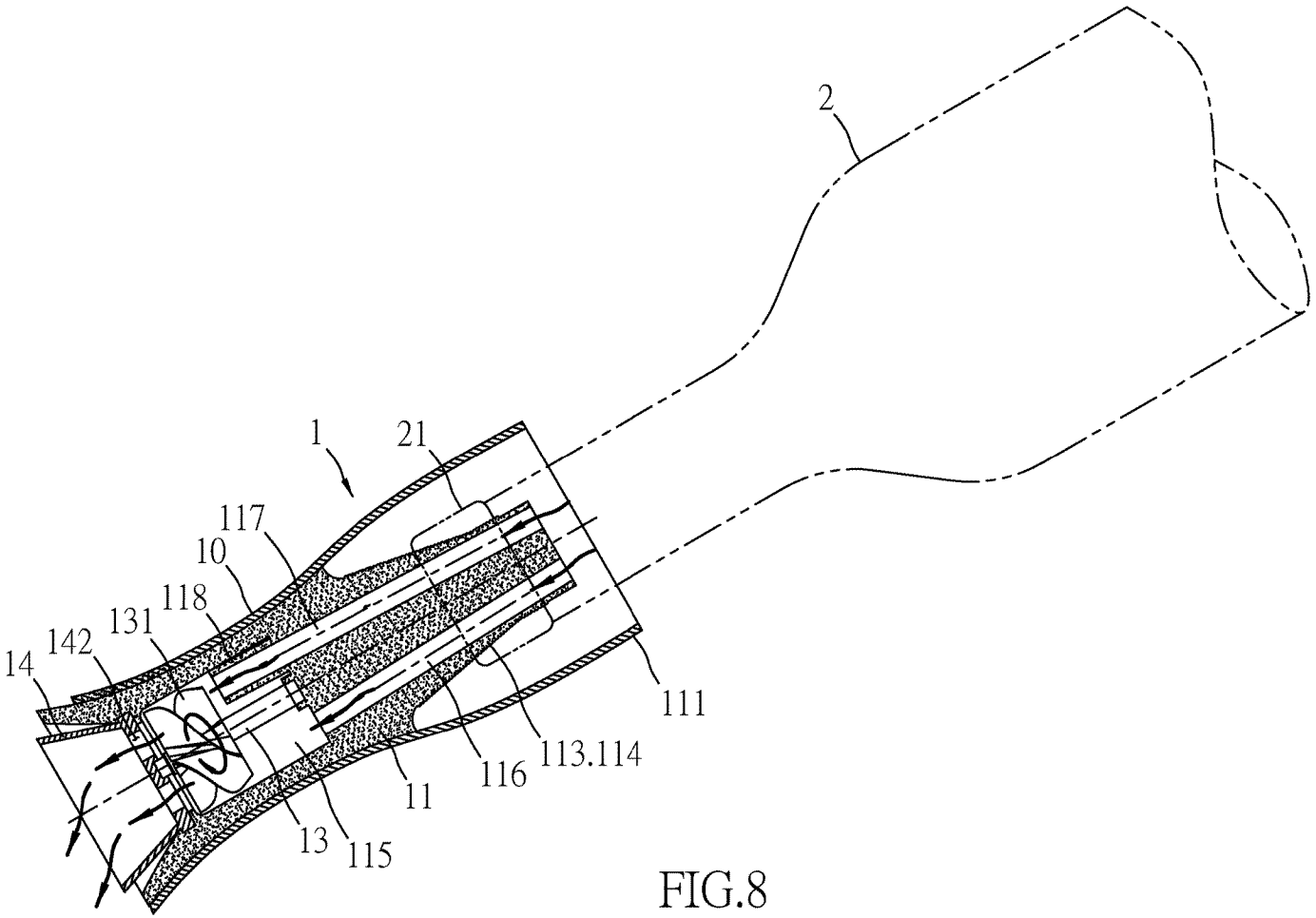
FIG. 8 is a schematic view of the decanter of the present invention applied to the bottle mouth of the wine bottle.

Referring to FIG. 8, the decanter of the present invention is applied to a bottle mouth 21 of a wine bottle 2. When in use, the bottle mouth insertion portion 113 of the main body 11 is inserted into the bottle mouth 21 of the wine bottle 2. Through the main body 11 that is integrally formed of elastic rubber and the retaining ring 114 on the outer wall of the bottle mouth insertion portion 113, the bottle mouth insertion portion 113 of the main body 11 of the present invention is tightly connected to the bottle mouth 21 of the wine bottle 2. When the wine in the wine bottle 2 is poured, the wine in the wine bottle 2 flows through the first through holes 116 and the second through holes 117 of the main body 1 of the decanter of the present invention to the accommodating chamber 115 having the rotary shaft 13 and the blade 131. The flowing wine will push the blade 131 to drive the rotary shaft 13 to rotate. The rotating blade 131 is adapted for oxygenating or aerating the wine. The contact area between the wine and the air increases to greatly shorten the time to soften the wine, thereby decanting the wine quickly. The wine that has been decanted rapidly flows through the wine guide hole 142 of the wine guide portion 14 to the tapered trough 143 that is reduced inwardly, and then is poured into the cup of the drinker.

Through the description of the above embodiments, it can be seen that the decanter for bottled wine according to the present invention has the following advantages:

1. Fast decanting: In the decanter for bottled wine according to the present invention, the height difference between the first through holes and the second through holes causes the air pressure of the wine bottle to be different for the wine to flow outwardly. When the flowing wine passes through the plurality of first through holes and the plurality of second through holes toward the blade, the blade and the rotary shaft are rotated. When the wine is disturbed by the air due to the rotation of the blade, the contact area between the wine and the air increases to greatly shorten the time to soften the wine. The purpose of the present invention is to obtain a perfect aeration or oxygenation of the wine in a very short time.

2. Power saving: The blade of the decanter for bottled wine according to the present invention is not driven by a power source or an external force for the wine to be aerated. The rotation of the blade is accomplished by the different air pressure of the bottled wine flowing outward, having the advantage of saving electricity.

3. It is convenient for use. When the decanter of the present invention is applied to the bottle mouth of the wine bottle, the bottle mouth insertion portion of the main body is inserted into the bottle mouth of the wine bottle. Through the retaining ring on the outer wall of the bottle mouth insertion portion, the decanter of the present invention is tightly connected to the bottle mouth of the wine bottle. It is convenient for use Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A decanter, comprising:

a main body, having a first end and a second end, the first end having a bottle mouth insertion portion that is enlarged inwardly, at least one retaining ring being provided on an outer wall of the bottle mouth insertion portion, the main body including an accommodating chamber at a middle portion thereof, a bottom of the accommodating chamber being provided with a plurality of equally spaced first through holes passing through the bottle mouth insertion portion, the accommodating chamber being provided with a plurality of protruding posts each having a second through hole, each of the protruding posts being arranged between every two of the first through holes;

an outer cylinder, covering the main body;

an inner shaft seat, protruding from a center of the bottom of the accommodating chamber;

a rotary shaft, an inner end of the rotary shaft being pivotally connected to the inner shaft seat, at least one blade being provided on an upper section of the rotary shaft; and a wine guide portion, disposed inside the second end of the main body and located at an outer end of the accommodating chamber, a center of the wine guide portion being provided with an outer shaft seat corresponding to the inner shaft seat, an outer end of the rotary shaft being pivotally connected to the outer shaft seat, the wine guide portion having at least one wine guide hole around the outer shaft seat.

2. The decanter as claimed in claim 1, wherein the at least one blade is spirally shaped.

3. The decanter as claimed in claim 1, wherein an outer end of the wine guide portion has a tapered trough that is reduced inwardly.

* * * * *